US007121416B2

(12) United States Patent
Shea

(10) Patent No.: US 7,121,416 B2
(45) **Date of Patent: *Oct. 17, 2006**

(54) MERCHANDISING DISPLAY INCORPORATING A FOUR-SIDED AND THREE-DIMENSIONAL DISPLAY SURFACE EXHIBITING GRAPHICS ADVERTISEMENTS

(76) Inventor: Thomas M. Shea, 984 Livernois, Troy, MI (US) 48083

( * ) Notice: Subject to any disclaimer, the term of this patent is extended or adjusted under 35 U.S.C. 154(b) by 169 days.

This patent is subject to a terminal disclaimer.

(21) Appl. No.: 10/702,882

(22) Filed: Nov. 6, 2003

(65) Prior Publication Data

US 2005/0098518 A1 May 12, 2005

(51) Int. Cl.
*A47G 5/08* (2006.01)

(52) U.S. Cl. ..... 211/87.01; 211/113; 248/220.31; 40/657

(58) Field of Classification Search ..... 211/87.01, 211/54.1, 57.1, 59.1, 113, 73, 85.26, 105.3, 211/175, 94, 162, 193, 118; 206/763; 40/124, 40/657; D6/553; 248/220.31, 220.43, 220.42
See application file for complete search history.

(56) References Cited

U.S. PATENT DOCUMENTS 2,676,699 A * 4/1954 Friedman ..... 206/763
2,838,166 A * 6/1958 Herdklotz ..... 206/763
2,868,386 A * 1/1959 Seyforth ..... 211/95
2,923,417 A * 2/1960 Sondsen ..... 211/165
2,942,364 A * 6/1960 Horton ..... 40/489
2,954,874 A * 10/1960 Rouse ..... 211/85.9
2,963,164 A * 12/1960 Watson ..... 211/1
2,991,889 A * 7/1961 Levy et al. ..... 211/190
3,231,097 A * 1/1966 Hodson ..... 248/220.42
3,433,365 A * 3/1969 Hodson ..... 248/220.31
3,661,269 A * 5/1972 Scherzer ..... 211/50
3,891,092 A * 6/1975 Surrette et al. ..... 211/85.1
4,211,331 A * 7/1980 Salmon et al. ..... 211/85.1
4,245,414 A * 1/1981 Shypula ..... 40/124
4,378,884 A * 4/1983 Anderson ..... 206/459.5
4,480,755 A * 11/1984 Cartwright ..... 211/70.6
4,606,467 A * 8/1986 Everett ..... 211/60.1
4,788,784 A * 12/1988 Templin ..... 40/657
4,815,612 A * 3/1989 Leo, Sr. ..... 211/189
4,880,117 A * 11/1989 Garganese ..... 206/487
D320,719 S * 10/1991 Kolsrud et al. ..... D6/553
5,083,668 A * 1/1992 Bushey ..... 211/59.1
D327,187 S * 6/1992 Swon ..... D6/553
5,249,771 A * 10/1993 Wear ..... 248/317
5,522,574 A * 6/1996 Maglione ..... 248/174

(Continued)

*Primary Examiner*—Richard E. Chilcot, Jr.
*Assistant Examiner*—Lindsay M. Maguire
(74) *Attorney, Agent, or Firm*—Gifford, Krass, Groh, Sprinkle, Anderson & Citkowski, P.C.

(57) ABSTRACT

A merchandising display assembly capable of being secured to an elevated surface, the assembly including a foldable and durable planar shaped and three-dimensional display element. Overlapping edges of the display element are adhesively secured together and to establish four interconnected sides with an open interior. A plurality of apertures are formed in aligning fashion through first and second selected and spaced apart sides of said display element and in order to secure display hangers supporting in turn pluralities of merchandise items. An advertising indicia placed upon at least one of said first and second selected and spaced apart sides and typically includes a multi-color graphics display imprinted upon a planar sheet of material in turn secured to the foldable board material. At least one fixed or adjustable elongated support extends from a selected location of the display element for securing said assembly.

14 Claims, 7 Drawing Sheets

U.S. PATENT DOCUMENTS 5,595,309 A * 1/1997 Bauer et al. ..... 211/59.1
5,620,104 A * 4/1997 Maglione ..... 211/59.1
5,762,207 A * 6/1998 Maglione ..... 211/59.1
5,785,190 A * 7/1998 Otema ..... 211/189
5,819,457 A * 10/1998 Parker ..... 40/657
D413,034 S * 8/1999 Markson ..... D6/553
5,957,422 A * 9/1999 Shea ..... 248/220.31
6,052,932 A * 4/2000 Reddig et al. ..... 40/611.07
6,070,747 A * 6/2000 Shea ..... 211/87.01
6,244,431 B1 * 6/2001 VanFleet ..... 206/6.1
6,442,035 B1 * 8/2002 Perry et al. ..... 361/756
6,473,984 B1 * 11/2002 Splain et al. ..... 33/613
6,536,613 B1 * 3/2003 Shea ..... 211/87.01
6,575,314 B1 * 6/2003 Lung et al. ..... 211/163
6,591,995 B1 * 7/2003 Grove ..... 211/87.01
6,675,978 B1 * 1/2004 Shea ..... 211/59.1
2003/0164346 A1 * 9/2003 Shea ..... 211/59.1
2005/0016943 A1 * 1/2005 Dick ..... 211/70.6
2005/0092705 A1 * 5/2005 Moss et al. ..... 211/132.1

* cited by examiner

MERCHANDISING DISPLAY INCORPORATING A FOUR-SIDED AND THREE-DIMENSIONAL DISPLAY SURFACE EXHIBITING GRAPHICS ADVERTISEMENTS

BACKGROUND OF THE INVENTION

1. Field of the Invention

The present invention relates generally to merchandising display assemblies for supporting pluralities of merchandise. More particularly, the present invention teaches a display incorporating a four-sided and three-dimensional display surface, such as which further exhibits a plurality of advertisements placed along at least first and second planar extending faces thereof.

2. Description of the Prior Art

The prior art is well documented with numerous examples of merchandising display assemblies for use in supporting pluralities of products for sale. The objective of such display assemblies is to utilize the free space normally existing beyond a conventional shelf or gondola display.

Examples of the prior art include U.S. Pat. No. 6,070,747, issued on Jun. 6, 2000, for a merchandising display structure which is mounted to a vertical support surface. The support surface includes an elongate and single slotted backplate with a plurality of spaced apart and linearly extending slots. At least one horizontal member is mounted to and extends from the support surface. The horizontally extending member in a specific embodiment includes first and second elongated portions and axially adjusting means for establishing a length between the elongated portions. An elongated display member is secured to an outer end of the horizontal member and extends in parallel fashion relative to the vertical support surface at a spaced distance. The display member exhibits a substantially flattened and two-dimensional display area for securing thereon a plurality of hanger portions which are in turn capable of supporting large volumes of small sized merchandise without obscuring additional merchandise located on the vertical support surface.

U.S. Pat. No. 5,957,422 discloses a reinforced strip display for supporting high volumes of smaller impulse merchandising and exhibits an elongated body including an upper end, a lower end, a front planar face and a rear planar face. A bracket secures to the upper end of the display assembly and suspends the assembly in vertical fashion from the shelving construction. A plurality of corrugations extend an axial length of the elongate body and separate the front and rear planar faces according to a selected thickness to provide reinforcing and rigid support to the display assembly along the axially extending direction. Pairs of spaced apart apertures are formed through the front and rear planar faces of the body at spaced apart intervals along the axial length of the body. A plurality of merchandise support members are provided which are individually attachable to the strip display assembly. Each of the support members includes a pair of hook engaging portions for securing to a selected pair of apertures and an elongated merchandise support arm extending from a selected one of said front and rear planar faces.

U.S. Pat. No. 6,536,613 discloses a merchandising display supported upon a vertically extending surface. The display includes a substantially horizontally extending and rigid support having a first end and a second end, the first end engaging with the vertically extending surface. A substantially vertically extending display is attached to the second end of the rigid support and exhibits a substantially thin and flattened construction which provides the display with flexibility both with respect to its own cross section and relative the rigid support. Pluralities of apertures are formed through the display and between first and second faces thereof. The pluralities of apertures further define individual pairs of apertures extending lengthwise along the flexible display. A plurality of merchandise support hangers are provided, each including a pair of tabs engaging through a selected pair of the apertures and so that respective pairs of the hangers extend in opposite and substantially proximate fashion from the first and second faces of the flexible display.

SUMMARY OF THE PRESENT INVENTION

The present invention discloses a merchandising display assembly capable of being secured to an elevated surface and for supporting a plurality of smaller sized point of purchase products. The assembly includes a foldable and durable planar shaped and three-dimensional display element.

Overlapping edges of the display element are adhesively secured together, such as by taping or gluing, and in order to establish four interconnected sides with an open interior. A plurality of apertures are formed in aligning fashion through first and second selected and spaced apart sides of said display element and in order to secure display hangers supporting in turn the pluralities of merchandise items.

An advertising indicia is placed upon at least one of said first and second selected and spaced apart sides and typically includes a multi-color graphics display imprinted upon a planar sheet of material in turn secured to the foldable board material. At least one fixed or adjustable elongated support extends from a selected location of the display element for securing said assembly. Among these are further including fixed or adjustable planar support arms as well as other types of planar and three-dimensional cross section support arms.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
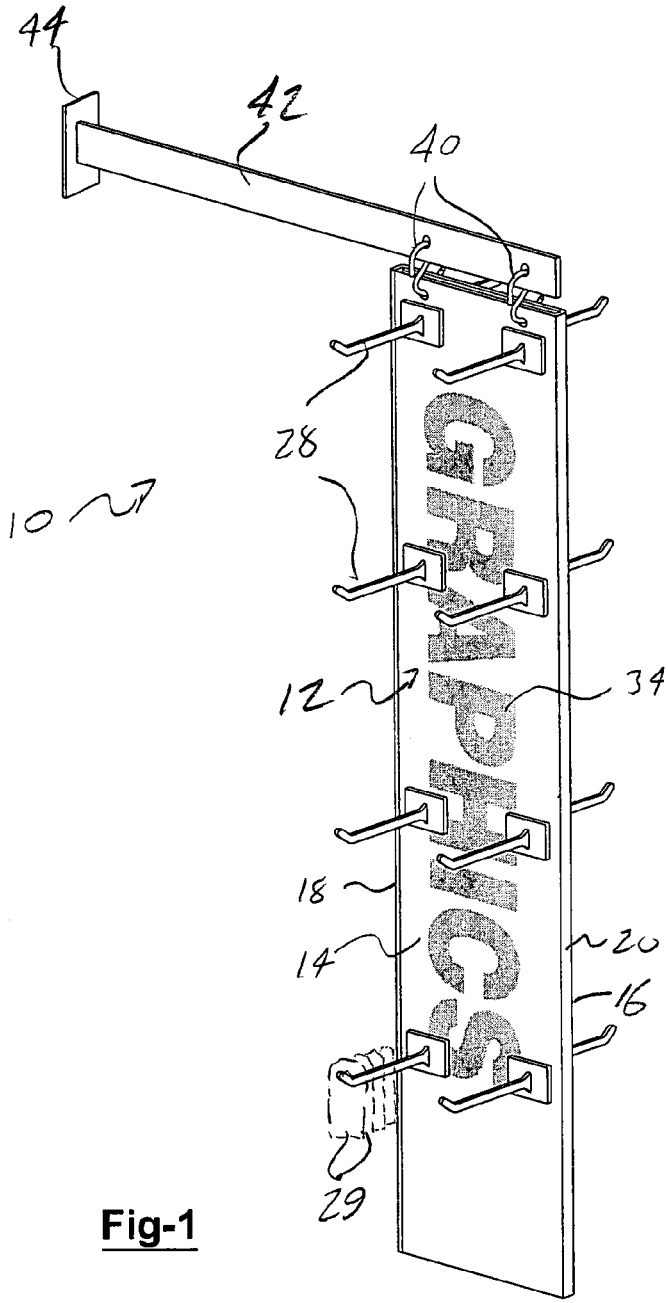
FIG. 1 is a perspective view of a merchandising display assembly according to a first preferred embodiment of the present invention with affixed product display hooks and in which the four-sided and internally hollowed three-dimensional display element is suspended from a substantially flattened and fixed support arm.

Referring now to FIG. 1, a perspective view is illustrated at 10 of a merchandising display assembly according to a first preferred embodiment of the present invention. The assembly 10 includes a display element, generally referenced at 12 in each of FIGS. 1–11 and 13.

In a preferred embodiment, the display element 12 is constructed from a durable and foldable board material having an elongated configuration and which exhibits, in cross section, first 14 and second 16 planar shaded sides and associated and interconnecting side edges 18 and 20. As best illustrated by the cross sectional views of FIGS. 10 and 11 and the sectional perspective of FIG. 13, overlapping edges of the foldable board material (see extending edge 18 with overlapping and inter-engaging edge 22) are secured together, such as for example adhesively by tape or glue, and in order to define a four-sided display element with an open interior by which the significant facing sides 14 and 16 are spaced apart a predetermined distance. It is also envisioned that the overlapping edges can be secured together such as by staples or the like and within the ordinary skill of one in the art. It is also understood that, aside from a foldable paper/cardboard type material, other materials including plastic, fiberboard or the like can be employed as an effective foldable board material and within the scope of the invention.

Figure 6:
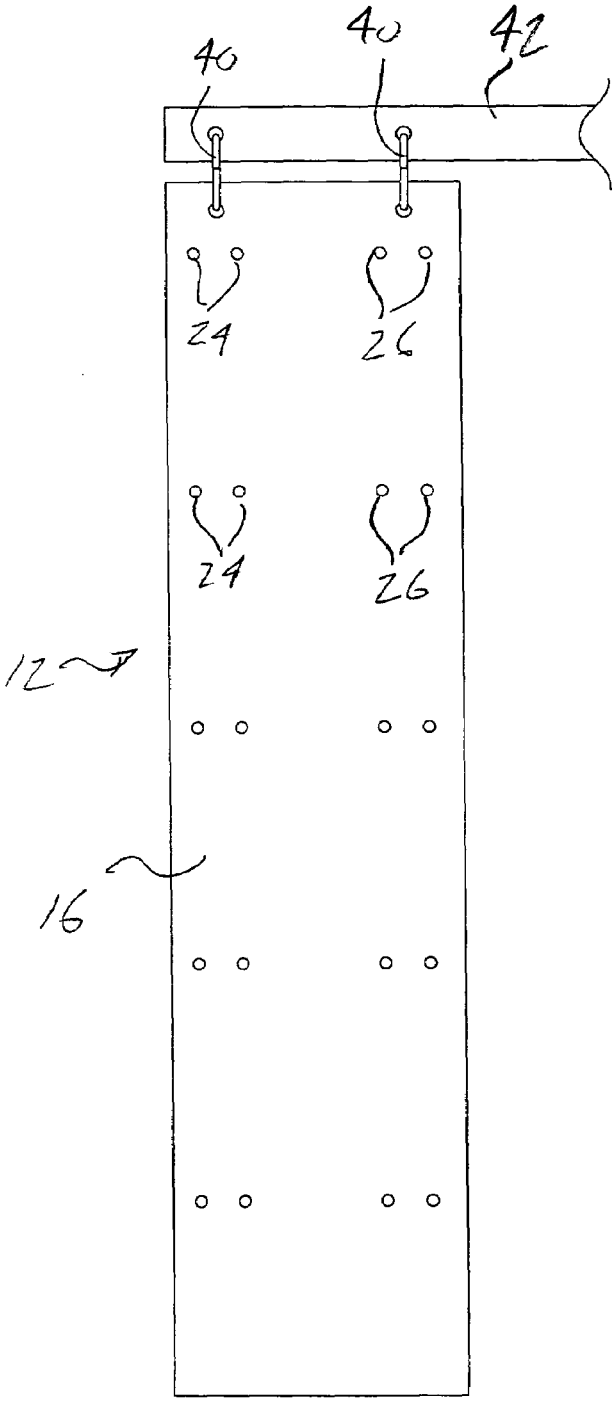
FIG. 6 is a planar right side view of the display element as substantially illustrated in FIG. 1 and showing the pairs of horizontally spaced apart and vertically extending apertures according to the present invention.
Figure 7:
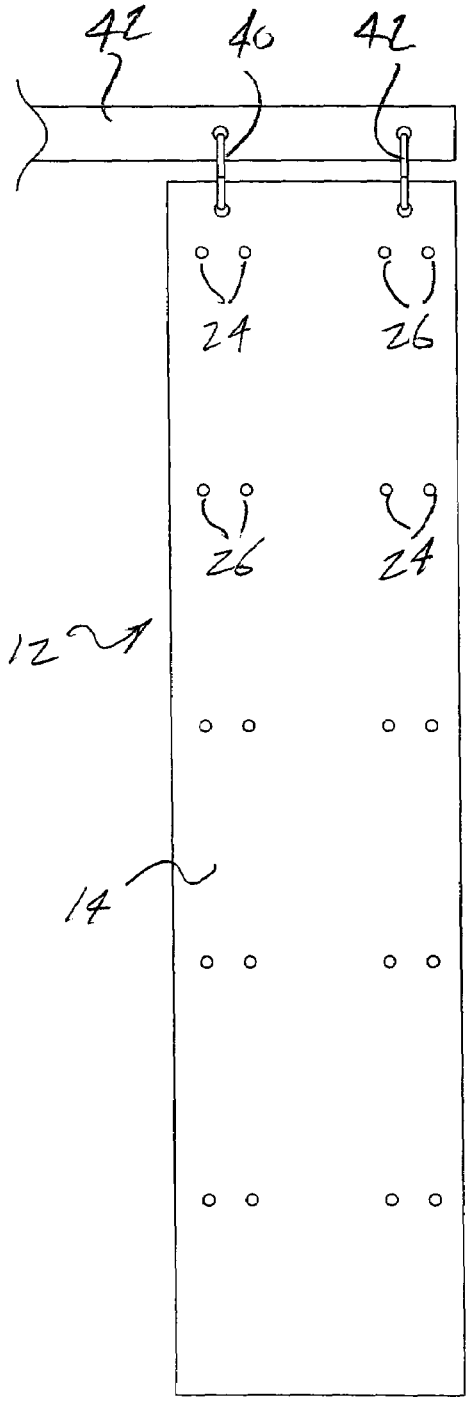
FIG. 7 is a planar left side view of the display element as illustrated in FIG. 6.
Figure 8:
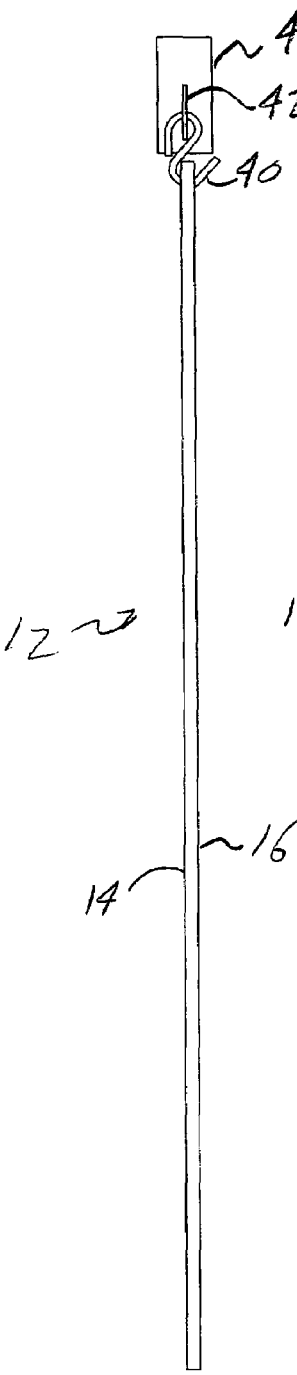
FIG. 8 is a front view of the merchandising display assembly as illustrated in FIG. 1.
Figure 9:
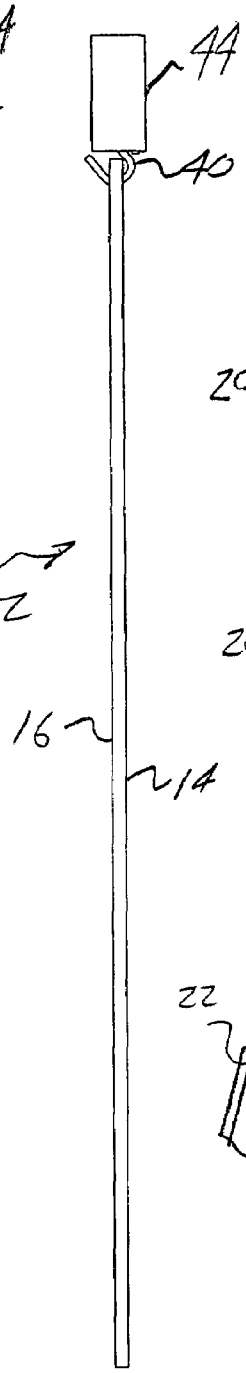
FIG. 9 is a rear view of the merchandising display assembly as illustrated in FIG. 1.
Figure 10:
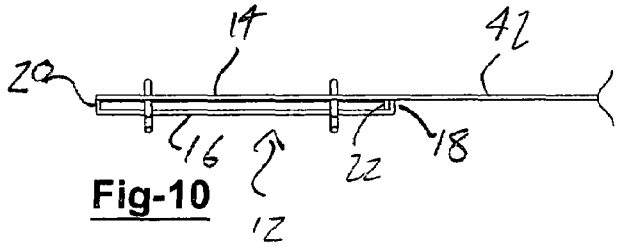
FIG. 10 is a top sectional view of the display element according to the present invention and illustrating in particular its folded and edge secured construction.
Figure 11:
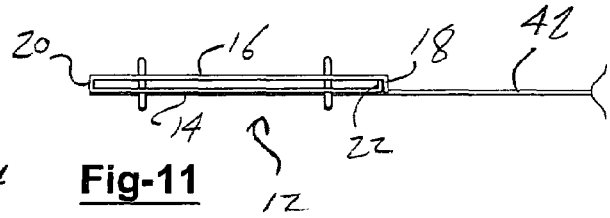
FIG. 11 is an opposite bottom sectional view of the display element as substantially shown in FIG. 10.

As is further best illustrated in the side views of FIGS. 6 and 7, pluralities of apertures, see individual, spaced apart and vertically extending pairs 24 and 26 of apertures, are provided in extending fashion along each of the first 14 and second 18 sides of the three-dimensional display element 12. Preferably, the individual aperture pairs 24 and 26 are in alignment as viewed from each of the first and second sides in FIGS. 6 and 7, respectively, it being understood that the apertures can also be arranged in any other fashion across the majority faces 14 and 16 of the elongated display element.

Figure 12:
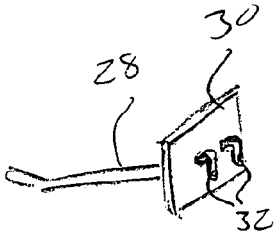
FIG. 12 is a rotated perspective view of a selected hanger portions illustrated in FIG. 1 and illustrating in particular the manner in which it engages a selected pair of apertures associated with said display element.

Referring to FIG. 12, a selected product display hanger is illustrated in perspective at 28 (these also being shown in plurality in each of FIGS. 1–5). The extending hook portion associated with the hanger 28 is suited for supported individual pluralities of specific point of purchase (POS) merchandise (see in phantom at 29 in FIG. 1). Referring again to FIG. 12, the display hangers 28 each further include a planar base support 30, from a rear facing side of which extends a pair of spaced apart and substantially "L" shaped tabs 32, the same inter-engaging selected pairs 24 and 26 (see again FIGS. 6 and 7) of the apertures and in order to be arrayed in the manner shown in each of the variants of FIGS. 1–5. It is also understood that the internal spacing of the facing sides 14 and 16 of the display element 12 is such that the tabs 32 of a hanger 28 associated with one of the major sides do not interfere or project from the other of the sides 14 or 16.

Figure 13:
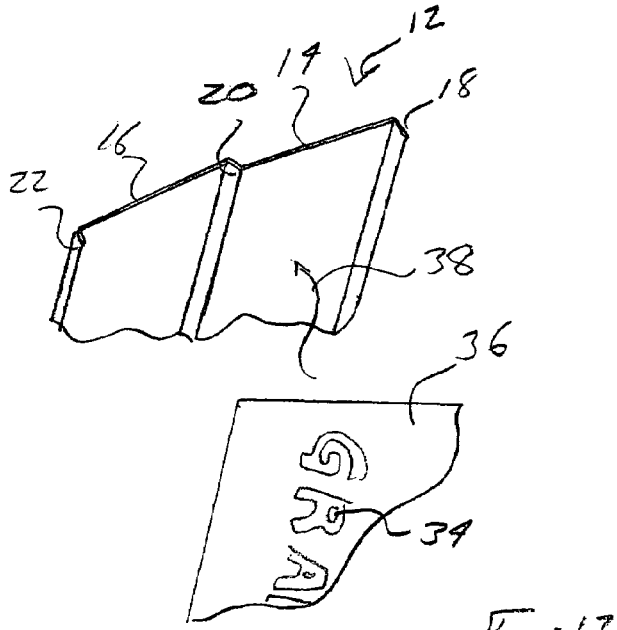
FIG. 13 is a sectional perspective illustration showing the foldable nature of the elongated board material and further showing a planar sheet of graphics imprinted material and which is secured upon a selected facing side of the foldable board material.

As referenced again in each of FIGS. 1–5, a graphics display indicia is generally represented at 34. Referring further to FIG. 13, the display indicia 34 is further illustrated as being imprinted upon a planar sheet of material (see at 36) and which is affixed to a facing side of the foldable display element board 12, see further such as at arrow 38, and typically prior to the board 12 being folded into the cross sectional configuration illustrated throughout the drawings.

It is further envisioned that the graphics display 34 include a multi-color (such as four color or the like) advertisement display and which includes indicia consistent with the nature of the pluralities of merchandise items (see again at 29 in FIG. 1) supported upon the individual hangers 28. It is still further understood that the arrangement and dimensions of the graphics display 34 is further such that it can cover up to all four sides of the foldable board material and will enhance and not be interfered with (or obscured by) the arrangement of the supported volumes of merchandise 29. The intention is that the planar element 12, in addition to supporting the volumes of merchandise, provides a significant point of purchase advertisement display.

Referring to each of FIGS. 1–5 in succession, a plurality of individual elongated supports are illustrated, in alternating variants, and in order to support the multi-sided, three-dimensional and elongated display element 12 in some desired fashion. Referring first to FIG. 1, the three-dimensional display element is suspended, such as by hooks 40 from a substantially flattened and fixed support arm 42 (see also side view FIGS. 6 and 7 and end views FIGS. 8 and 9). The support arm 42 further terminates in an opposite end in a planar shaped end bracket 44, in turn capable of being secured in any fashion to a specific elevated support location (not shown) and including a pegboard support, gondola shelf edge, side and end cap rails, and the like.

Figure 2:
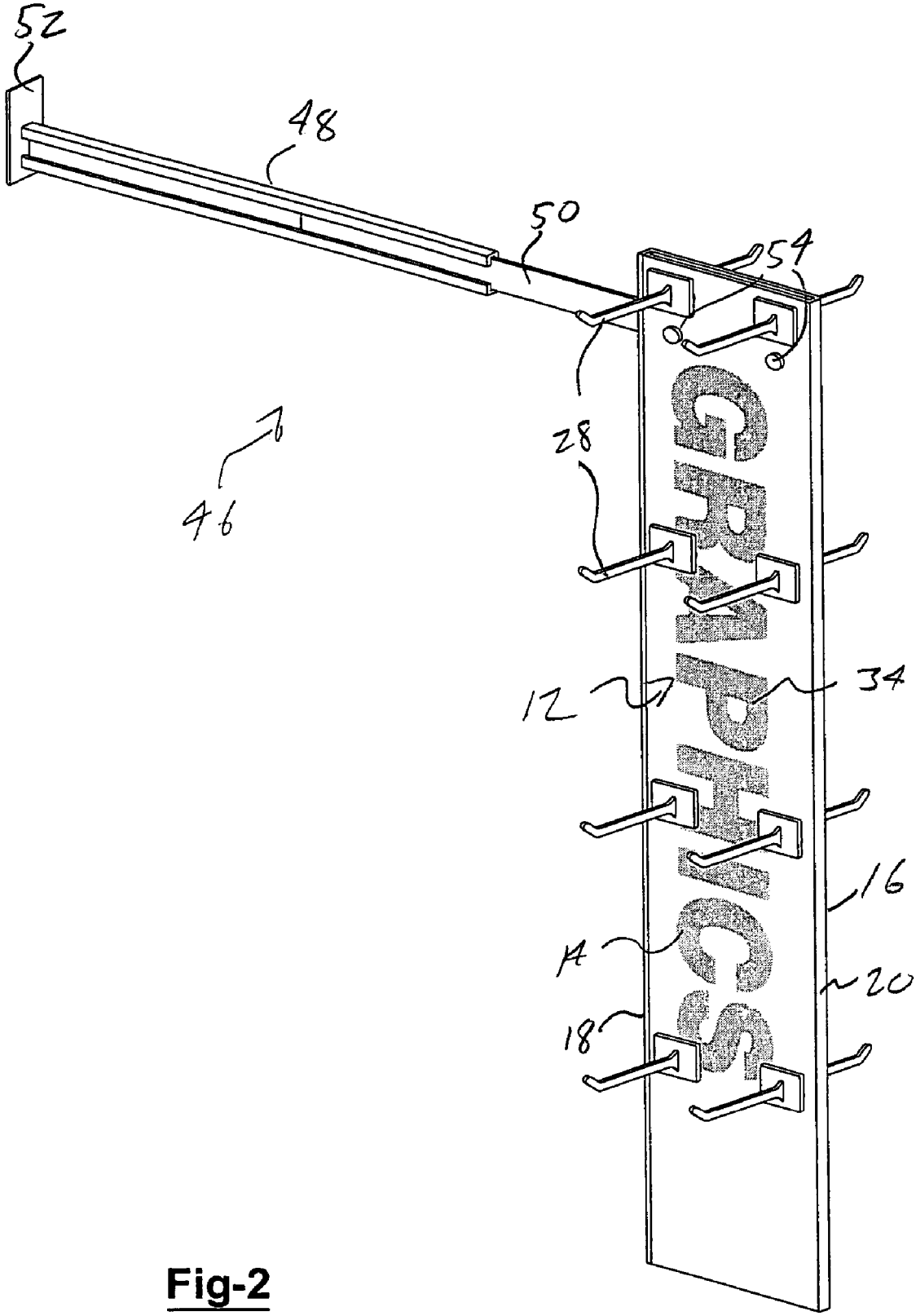
FIG. 2 is a perspective view of a merchandising display assembly according to a second preferred embodiment and by which the three-dimensional display element is secured to a substantially flattened and adjustable arm.

Referring to FIG. 2, an illustration is referenced generally at 46 of a further preferred variant of the present invention and which discloses a merchandising display assembly according to a second preferred embodiment, and by which in particular the three-dimensional display element 12 is secured to a substantially flattened and adjustable arm. The support arm includes an outer track 48 and a slidably disposed inner track 50 terminating in an end bracket 52.

Figure 3:
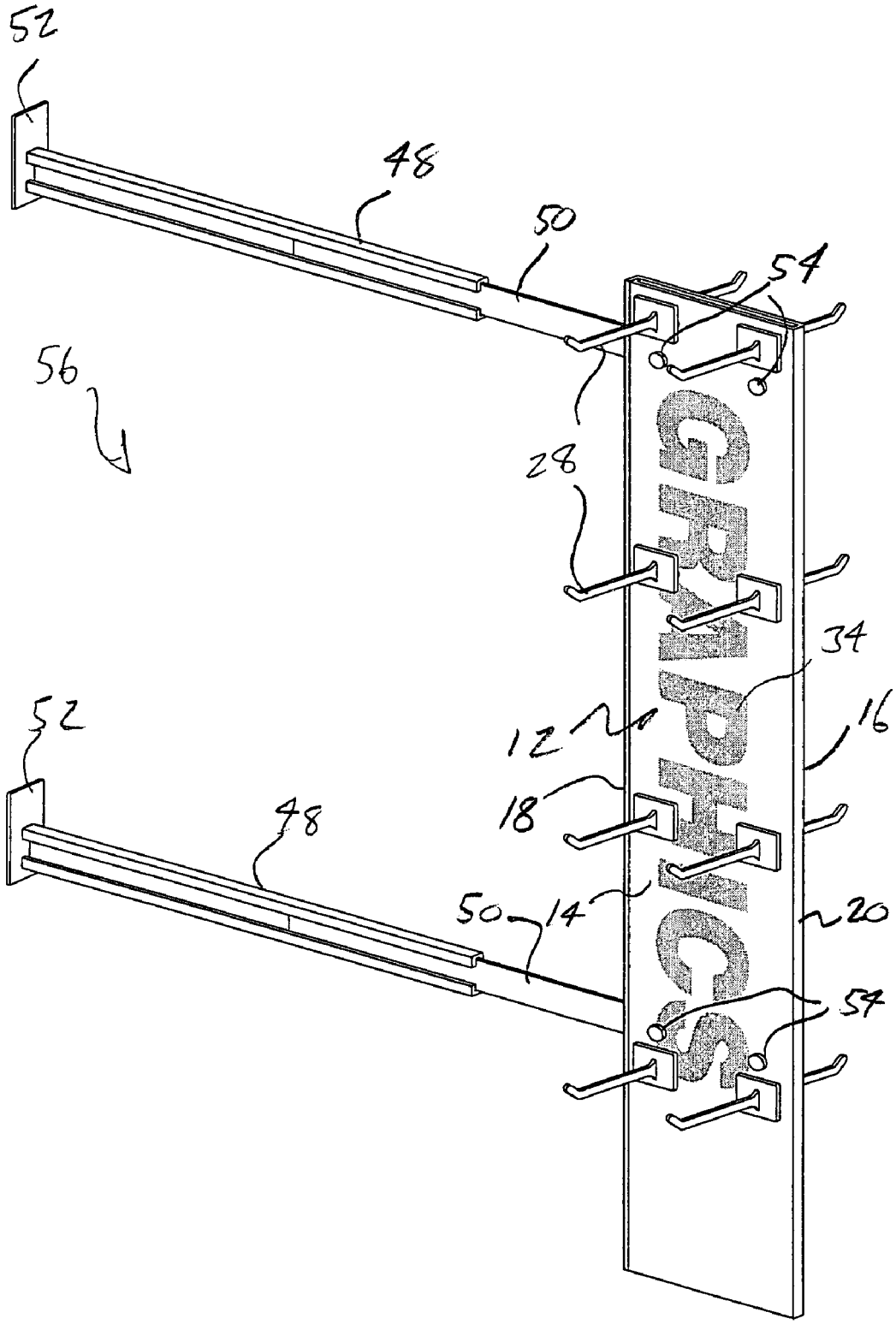
FIG. 3 is a perspective view of a merchandising display assembly according to a third preferred embodiment and by which a pair of flattened and adjustable arms are secured to corresponding first and second locations of the three-dimensional display.

Rather than being suspended by hooks, planar display element 12 is secured to the inner track 50 of the adjustable bracket by pins or other mechanical fasteners 54. Although not shown, the inner track 50 may be repositioned along the outer track 48 by thumb screws or the like and so that the product display can be extended or retracted to a desired position relative to the support surface location. Referring to FIG. 3, a perspective view of a merchandising display assembly according to a third preferred embodiment is generally illustrated at 56 and by which a pair of flattened and adjustable arms are secured to corresponding first and second locations of the three-dimensional display in the fashion generally described in FIG. 2.

Figure 4:
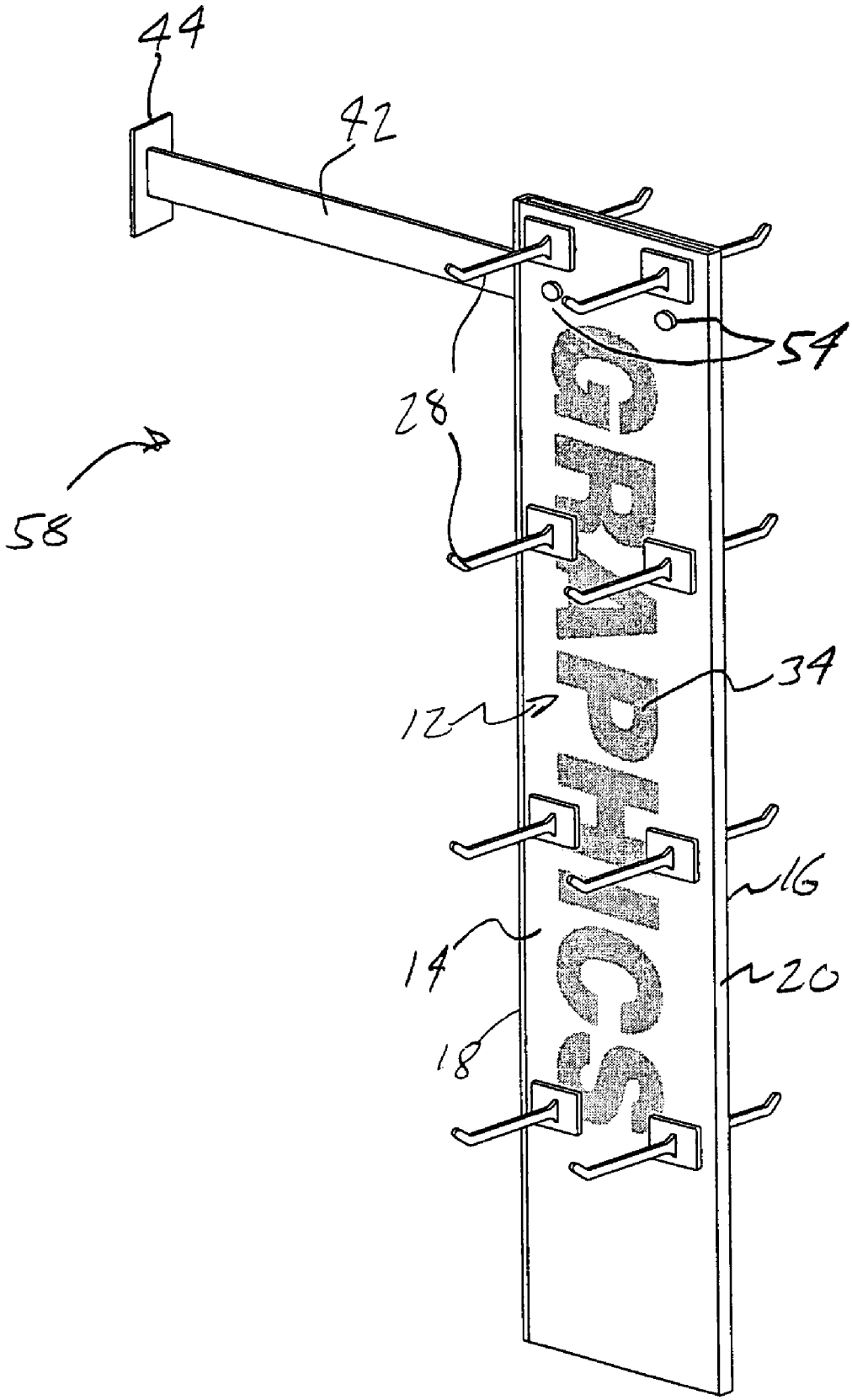
FIG. 4 is a perspective view of a merchandising display assembly according to a fourth preferred embodiment and by which the four-sided and internally hollowed three-dimensional display element is fixed from a single substantially planar shaped arm.

Referring now to FIG. 4, a perspective view of a merchandising display assembly according to a fourth preferred embodiment is illustrated at 58 and by which the four-sided and internally hollowed three-dimensional display element is fixed from a single substantially planar shaped arm, such as previously described at 42 in FIG. 1. The notable difference to the variant of FIG. 4 includes the planar display element 12 being secured again by pins or suitable fasteners to the planar fixed display arm 42.

Figure 5:
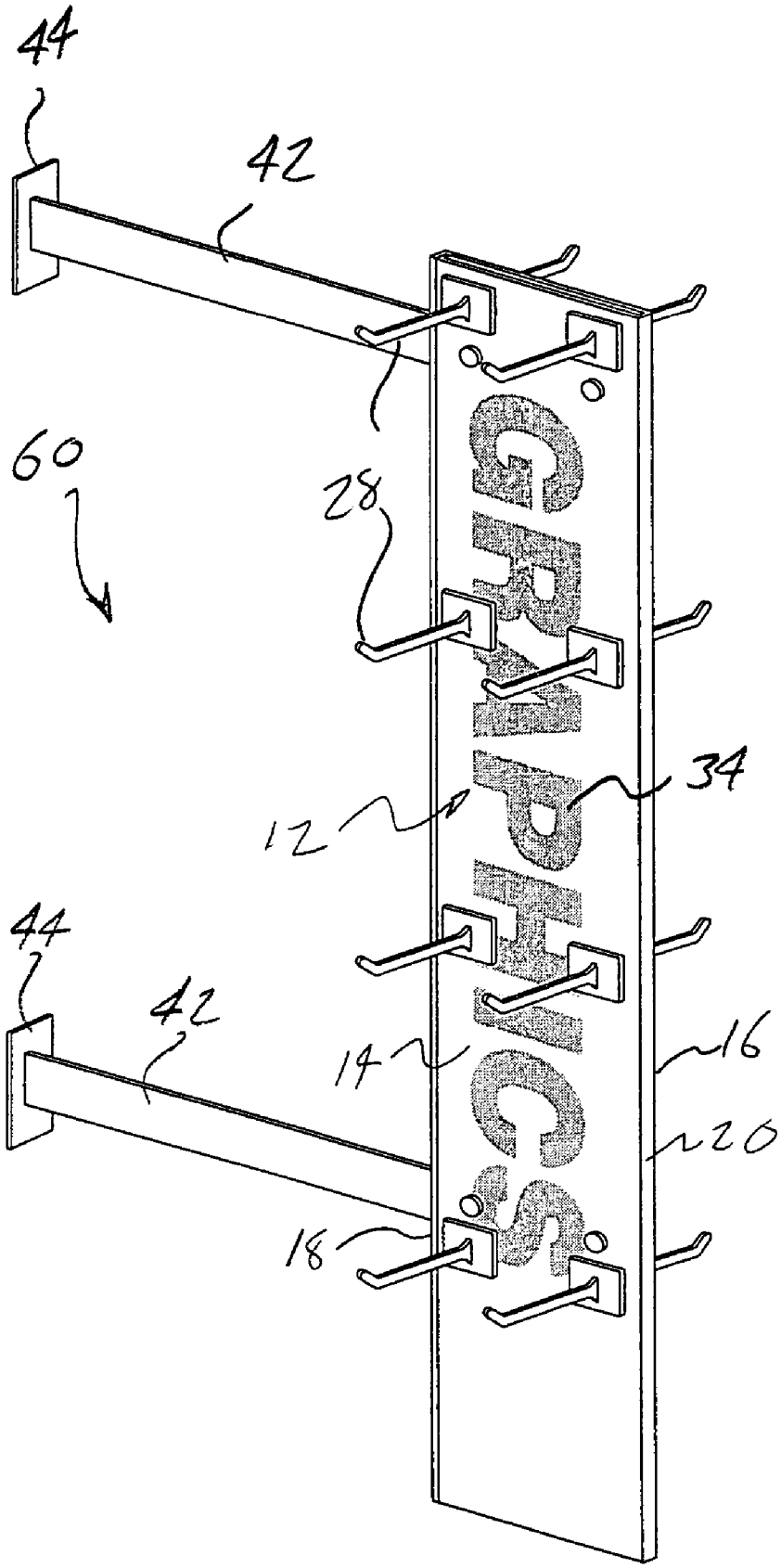
FIG. 5 is a perspective view of a merchandising display assembly according to a fifth preferred embodiment of the present invention and which illustrates the display element secured to a pair of spaced apart and fixed support arms.

Referring further to FIG. 5, a perspective view is shown at 60 of a merchandising display assembly according to a fifth preferred embodiment of the present invention and which illustrates the display element secured to a pair of spaced apart and fixed support arms 42 as previously described. Other and additional variants, not shown, include (without limitation) the provision of a fixed or adjustable support arm exhibiting a three-dimensional cross section with telescoping inner and outer portions.

Having described my invention, other and additional preferred embodiments will become apparent to those skilled in the art to which it pertains, and without deviating from the scope of the appended claims.

I claim:

1. A merchandising display assembly capable of being secured to an elevated surface, said assembly comprising:

a substantially elongated, planar shaped and three-dimensional display element, said display element exhibiting, in cross section, four interconnected sides with an open interior and further comprising a durable and foldable board material, overlapping edges of said material being secured together;

a plurality of features formed in aligning fashion through first and second selected and spaced apart sides of said display element;

an advertising indicia imprinted upon said first and second selected and spaced apart sides;

a plurality of merchandise support hanger portions secured to selected apertures and so that said hanger portions extend from said display element in a non-obscuring manner relative to said advertising indicia; and at least one elongated support extending from a selected location of said display element for securing said assembly in a spaced and suspended fashion relative to the elevated surface.

2. The merchandising display assembly as described in claim 1, further comprising said overlapping edges of said material being adhesively secured together.

3. The merchandising display assembly as described in claim 1, further comprising said overlapping edges of said material being stapled together.

4. The merchandising display assembly as described in claim 1, said advertisement indicia further comprising a multi-color graphics display corresponding to the nature of pluralities of merchandise items supported upon hangers secured to said display element.

5. The merchandising display assembly as described in claim 4, said graphics display being exhibited on both first and second selected and spaced apart sides of the display element.

6. The merchandising display as described in claim 4, said graphics display being exhibited on four interconnected sides and edges of the display element.

7. The merchandising display assembly as described in claim 4, further comprising said graphics display imprinted upon a flat sheet of material affixed to said foldable board material.

8. The merchandising display assembly as described in claim 1, said elongated support further comprising a substantially flattened and fixed support arm from which said display element is secured.

9. The merchandising display assembly as described in claim 8, further comprising said display element being suspended from said fixed support arm.

10. The merchandising display assembly as described in claim 1, said elongated support further comprising a substantially flattened and adjustable arm.

11. The merchandising display assembly as described in claim 1, said elongated support further comprising a pair of flattened and adjustable arms secured to corresponding first and second locations of said three-dimensional display element.

12. The merchandising display assembly as described in claim 1, said elongated support further comprising said display element being suspended, at first and second locations, from a pair of spaced apart and fixed support arms.

13. A merchandising display assembly capable of being secured to an elevated surface, said assembly comprising:

a substantially elongated, planar shaped and three-dimensional display element, said display element comprising a durable and foldable board material, overlapping edges of said material being secured together to exhibit, in cross section, four interconnected sides with an open interior;

a plurality of apertures formed in aligning fashion through first and second selected and spaced apart sides of said display element;

an advertising indicia imprinted upon first and second selected and spaced apart sides, said advertising indicia further comprising a multi-color graphics display corresponding to a type of merchandise supported upon said display element;

a plurality of merchandise support hanger portions secured to selected apertures and so that said hanger portions extend from said graphics display in a non-obscuring manner relative to said display indicia; and at least one elongated support extending from a selected location of said display element for securing said assembly in a spaced and suspended fashion relative to the elevated surface.

14. A merchandising display assembly capable of being secured to an elevated surface, said assembly comprising:

a substantially elongated, planar shaped and three-dimensional display element, said display element comprising a durable and foldable board material, overlapping edges of said material being adhesively secured together to exhibit, in cross section, four interconnected sides with an open interior;

a plurality of apertures formed in aligning fashion through first and second selected and spaced apart sides of said display element, a plurality of merchandise support hangers securing to selected pairs of apertures and supporting thereupon volumes of merchandise;

an advertising indicia placed upon said first and second selected and spaced apart sides, said advertising indicia further comprising a multi-color graphics display corresponding to a type of merchandise supported upon said display element, said graphics display being imprinted upon a planar sheet of material affixed to said foldable board material;

a plurality of merchandise support hanger portions secured to selected apertures and so that said hanger portions extend from said graphics display in a non-obscuring manner relative to said display indicia; and at least one elongated support extending from a selected location of said display element for securing said assembly in a spaced and suspended fashion relative to the elevated surface.

* * * * *